US007282473B2

(12) United States Patent
Hunt et al.

(10) Patent No.: US 7,282,473 B2
(45) Date of Patent: Oct. 16, 2007

(54) BINDER SYSTEMS FOR MICROCAPSULE TREATMENTS TO FIBERS, FABRICS AND GARMENTS

(75) Inventors: Michael O. Hunt, Greensboro, NC (US); Gregory P. Weeks, Hockessin (DE); Louise Arrowsmith, Gloucester (GB); Mary J. Wahlstrom, Waynesboro, VA (US)

(73) Assignee: INVISTA North America S.àr.l., Wilmington, DE (US)

( * ) Notice: Subject to any disclaimer, the term of this patent is extended or adjusted under 35 U.S.C. 154(b) by 397 days.

(21) Appl. No.: 10/932,525

(22) Filed: Sep. 2, 2004

(65) Prior Publication Data

US 2006/0043328 A1 Mar. 2, 2006

(51) Int. Cl.
*C11D 17/00* (2006.01)

(52) U.S. Cl. ..... 510/349; 510/441; 510/475; 510/501

(58) Field of Classification Search ..... 510/349, 510/441, 475, 501
See application file for complete search history.

(56) References Cited

U.S. PATENT DOCUMENTS

| | | | | |
|---|---|---|---|---|
| 4,247,592 | A | 1/1981 | Kalinowski | |
| 4,661,577 | A | 4/1987 | Lane et al. | |
| 6,153,207 | A | 11/2000 | Pugliese | |
| 6,596,289 | B1 | 7/2003 | Pugliese | |
| 2005/0256027 | A1* | 11/2005 | Heibel et al. | 510/515 |
| 2005/0288198 | A1* | 12/2005 | Pereira et al. | 510/130 |
| 2006/0168739 | A1* | 8/2006 | Caswell et al. | 8/115.51 |

* cited by examiner

*Primary Examiner*—John R. Hardee
(74) *Attorney, Agent, or Firm*—Christina W. Geerlof

(57) ABSTRACT

A binder system for applying microcapsules to textile materials includes microcapsules in a binder composition. The binder composition includes: (i) a component selected from the group consisting of: an alkoxylated fatty acid amide, alkyl sulfonate salt, an amino-silicone softener, and mixtures thereof; an (ii) a component selected from the group consisted of: a global type wrinkle resistant resin, an imidazole type wrinkle resistant resin, a cationic polyamide, a curable silicone resin, a polyurethane resin, and mixtures thereof. Methods for making the binder system as well as methods for applying the binder system to textile materials are also provided.

3 Claims, No Drawings

BINDER SYSTEMS FOR MICROCAPSULE TREATMENTS TO FIBERS, FABRICS AND GARMENTS

FIELD OF THE INVENTION

The present invention relates to binder systems that can be used to bind microcapsules to textile materials, to textile materials containing such binder systems, and to methods of making binder systems as well as methods of applying such systems to textile materials.

BACKGROUND OF THE INVENTION

One technique that can be used to enhance performance, aesthetics or other characteristics of fibers or fabrics involves providing a material or agent, for example a fragrance, in small microcapsules that can then be applied to the desired fiber or fabric. Microcapsules typically comprise a core, which contains at least one material or agent, surrounded by a thin wall. The material or agent can be released when microcapsule walls rupture or otherwise disintegrate in response to appropriate stimuli, such as temperature, pressure or physical contact with the wearer's skin.

Microcapsules commonly are applied to textile materials using agents called binders. A number of approaches can be used to apply microcapsules to textile materials using binders. For example, in one approach, a textile material is placed in a bath containing both microcapsules and binders followed by heating or drying of the textile material. Other approaches involve contacting textile materials with binders before adding microcapsules. Yet other approaches involve coating microcapsules with binders prior to applying them to textile materials. Within any of these approaches, the degree to which microcapsules adhere to a particular textile material is typically a function of not only the process used but also of the binder material or materials selected. Accordingly, the choice of binder materials or binder system components can be of particular importance in the successful application of microcapsules to textiles.

It can be challenging to incorporate textiles containing microencapsulated materials into clothing and apparel. For example, a fabric containing microencapsulated materials may not have good washfastness or durability, meaning the fabric quickly loses the ability to retain the characteristic(s) or effect(s) provided by the microencapsulated material(s) through extended use and/or multiple washing cycles. In this regard, use of a particular binder may result in significant variability when applied to different fabric types and structures, i.e., it may provide good washfastness in some applications and poor washfastness in others.

In addition to issues relating to washfastness or durability, fabrics containing microcapsule finishes may have poor micro dispersability, meaning that the microcapsules have a tendency to coagulate in bunches, thereby increasing the average unit size deposited and decreasing the ability of the microcapsules to penetrate and bond in a fabric structure. Fabrics containing microcapsules may also contain a high ratio of binder material to microcapsules, which can add stiffness and detract from the tactility of the fabric. In addition, a particular binder composition may contain toxic components that are not easily disposed of at a processing facility. Alternatively, a particular microcapsule/binder combination may not be compatible with other ingredients, such as softeners, that are commonly used in the apparel fabric industry. Finally, a given system of microcapsules and/or binder materials may present particular processing difficulties, such as microcapsule wall polymers that do not have sufficient thermal stability to withstand common textile processing or binder systems that require extended high temperature cure times that are not efficient in standard processing facilities. Accordingly, in applying microcapsules to textile materials, a need exists for binder components and systems that can address one or more of these challenges.

SUMMARY OF THE INVENTION

The present invention relates to a binder system comprising microcapsules and a binder composition. The binder composition comprises: (i) a component selected from the group consisting of: an alkoxylated fatty acid amide, alkyl sulfonate salt, an amino-silicone softener, and mixtures thereof: and (ii) a component selected from the group consisting of a glyoxal type wrinkle resistant resin, an imidazole type wrinkle resistant resin, a cationic polyamine, a curable silicone resin, a polyurethane resin, and mixtures thereof. The present invention further relates to methods of making such a binder system as well as fabrics comprising such a binder system.

DETAILED DESCRIPTION OF THE INVENTION

The applicants have discovered that certain binding materials and systems can be advantageously used in applying microcapsules to fibers and fabrics. In particular the applicants have discovered that certain binding materials and systems can allow the characteristic(s) or effect(s) provided by microencapsulated material(s) to be present even after extended wear and/or multiple washings by the end user.

Combinations of binder materials that the applicants have found to be particularly useful for applying microcapsules to fabrics include combinations of: (i) a component selected from the group consisting of: an alkoxylated fatty acid amide, alkyl sulfonate salt, an amino-silicone softener, and mixtures thereof: and (ii) a component selected from the group consisting of a glyoxal type wrinkle resistant resin, an imidazole type wrinkle resistant resin, a cationic polyamine, a curable silicone resin, a polyurethane resin, and mixtures thereof.

By "alkoxylated fatty acid amide, alkyl sulfonate salt", it is meant a fatty acid amide comprising at least one sulfonate group and at least one product of a ring opening polymerization reaction of an alkylene oxide ring, such as ethylene oxide or propylene oxide. An example of such a material is SAPAMINE CKG, supplied by CIBA Specialty Chemical.

By "amino-silicone softener", it is meant softeners comprising polysiloxanes having aminofunctional groups, such as those disclosed in U.S. Pat. Nos. 4,661,577 and 4,247,592, the entire disclosures of which are incorporated herein by reference. An example of an amino-silicone softener is Kelmar AF 2340 supplied by Kelmar Industries, Inc.

By "wrinkle resistant resin", it is meant resins that are conventionally used to form crosslinks within and between cellulosic fibers in fabrics comprised of such fibers, such as cotton. A "glyoxal type wrinkle resistant resin" comprises or is processed through use of a glyoxal type reactant, for example, dimethylol dihydroxyethylene urea ("DMDHEU"). DMDHEU is a cyclic condensation product of glyoxal, urea, and formaldehyde that, applied as a wrinkle resistant resin, undergoes ring opening in the presence of heat and acid salts, such as mineral acid salts, for example, $MgCl_2$. Examples of glyoxal type wrinkle resistant resins include: CIBATEX RS-PC, a pre-catalyzed low formaldehyde, glyoxal type DMDHEU supplied by CIBA Specialty Chemicals, and NOVEON FREEREZ NTZ, a pre-catalyzed DMDHEU-based resin supplied by Noveon (formerly B.F. Goodrich).

Other wrinkle resistant resin chemistries include "imidazole type wrinkle resistant resins", which are based on ring-opening polymerization of imidazole derivatives. An example of an imidazole type wrinkle resistant resin is CIBATEX RCT, a precatalyzed lower temperature cure resin supplied by CIBA Specialty Chemicals.

Cationic polyamines can also be used in the present invention. An example of a cationic polyamine is Binder ST supplied by Celessence International of the United Kingdom.

Curable silicone or polysiloxane resins can also be used in the present invention. These resins are typically made via the ring opening polymerization of siloxane monomers. The polymers may contain repeat units with functional groups for further derivatization or they may be reacted to give crosslinks. Such groups can include silanols (Si—OH), silanes (Si—H), and organic unsaturated groups. Examples of silicone resins include CIBATEX HM-DFS, a crosslinkable silicone supplied by CIBA Specialty Chemicals, Polon MF-56 made by Shin Etsu, 75 SF Emulsion supplied by Dow Corning, and 2-8818 Emulsion supplied by Dow Corning.

Polyurethane resins can also be used in the present invention. These materials typically comprise the reaction product of diols (di-alcohols) and diisocyanates, and may contain other functional groups which may further crosslink. The stoichiometry of the monomers may be adjusted such that the polymer may have endgroups of only the alcohol or only the isocyanate. This product may then be further reacted with an appropriate other monomer to achieve further polymerization or crosslinking once exposed to the appropriate temperature or pH conditions. An example of a polyurethane resin that can be used is CIBATEX MP-PU supplied by CIBA Specialty Chemicals.

By "microcapsules", it is meant liquid and/or solid component(s) ("microencapsulated materials") contained within a shell of another material. While not limited to any particular shape or material(s), the shell, may, for example, be spherical, and may, for example, comprise at least one material selected from gelatin, urea-formaldehyde, chitosan, and/or melamine-formaldehyde. Specific examples of shell materials include polymers of poly(methyleneurea) ("PMU"), poly(oxymethyleneurea) ("POMU"), and poly (oxymethylenemelamine) ("POMM").

The microcapsules can be produced through any process known or useful in the art, such as a heterogeneous dispersion process in which the target material to be encapsulated is dispersed within a continuous phase (such as water) and the material(s) used for the shell can be dispersed so as to be at the interface of the target encapsulate material and the continuous phase. The shell material can then, for example, be "hardened" via polymerization and cross-linking through pH, catalysis, and/or temperature conditions.

The microencapsulated materials that can be used in conjunction with the binders and binder systems described herein are not limited to any particular material or class of materials and include, for example, fragrances, deodorants, skin moisturizers, vitamins, dyes, pigments, antioxidants, acids, bases, bleaches, peroxides, adhesives, catalysts, cosmetic oils, softening agents, elasticity improving agents, water repellant agents, insect repellants, heat-proofing agents, flame retardants, anti-shrinking agents, and bacteriostatic agents. Specific examples of microencapsulated materials that may be used include aloe vera, vitamin E, lavender scent, peppermint scent, and sea kelp extract. Specific examples of microcapsules include Peppermint Microcapsules sold by International Flavors and Fragrances ("IFF"), as well as CTA-1 Aloe Vera microcapsules, CTA-3 Vitamin E microcapsules, and CTA-4 Sea Kelp microcapsules, each supplied by INVISTA, S.à r.l.

The types of fabrics that can be used in conjunction with the binders and binder systems described herein are not limited to any material or class of materials and include, for example, polyesters, polyester/elastane blends, polyamides, polyamide/elastane blends, cotton, cotton/elastane blends, cotton/polyester blends, cotton/polyester/elastane blends, polyacrylonitriles, cellulose acetates, modal, lyocell, linens, and wool. Particular examples of fabrics that can be used include circular knits, warp knits, hosiery knits, socks and wovens.

By "binder system" it is meant a formulation of components that when mixed and applied to a fabric followed by a thermal treatment to cure the resin, yields a fabric with a microencapsulated component with good durability to machine or hand laundering.

The binder systems and fabrics of the invention may include softeners in addition to those disclosed above. Examples of such softeners include: CIBATEX HM-FE, a silicone emulsion, and CIBATEX HM-DFS, a cross-linkable silicone, both supplied by Ciba Specialty Chemicals. Other softeners include NOVEON Fabritone LT-M8, supplied by Noveon. In addition, the alkoxylated fatty acid amide, alkyl sulfonate salt SAPAMINE CKG, supplied by Ciba Specialty Chemicals, can act as a softener.

In one embodiment, the binder composition comprises a glyoxal type wrinkle resistant resin and an alkoxylated fatty acid amide, alkyl sulfonate salt. The glyoxal type wrinkle resistant resin and alkoxylated fatty acid amide, alkyl sulfonate salt, can be combined by adding appropriate quantities of glyoxal type wrinkle resistant resin solution and alkoxylated fatty acid amide, alkyl sulfonate salt solution (by mass or volume) into water with good mixing to ensure complete dissolution and dispersion of the components. A similar procedure can be followed when the binder composition comprises other combinations of components, such as the combination of a cationic polyamine and an amino-silicone softener.

The binder composition can then be combined with microcapsules to form a binder system by adding the appropriate quantity of microcapsule slurry to water with good mixing to ensure completely homogeneous dispersion of the microcapsules into the water. This diluted microcapsule dispersion can then be added to a larger volume mixture of binder composition components and water. This formulation can then be mixed well to give a homogeneous dissolution and dispersion of components to provide an even application of the formulation components to the fabric.

The formulation can then be transferred to a "pad bath" through which the fabric can then be immersed followed by removal of excess formulation liquid upon passing through pressure ("nip") rolls. The fabric containing the aqueous formulation can then be passed through a stenter frame (large oven) to dry the fabric and thermally cure the resin.

Fabrics falling within the scope of the present invention can be used in a variety of applications, including but not limited to athletic apparel, intimate apparel, hosiery (such as sheer pantyhose and socks), ready-to-wear, and swimwear. These fabrics have unexpectedly improved washfastness (wash durability) and ability to retain the desired effect provided by the microencapsulated material. For example, when the microencapsulated material is a fragrance, fabrics falling within the scope of the present invention have the ability to retain the fragrance, even after numerous washings and extended wear by the end user.

Provided below are methods used to test the wash durability of the fabrics produced in the examples which follow, as well as methods used to test the ability of the fabrics to retain a microencapsulated fragrance.

Test Methods

For the wash durability testing method, a machine wash cycle with warm (40° C.) water was followed by a cold rinse (room temperature water) using American Association of Textile Chemists and Colorists (MTCC) WOB Standard Powder Detergent. The fabric was dried by hanging at room temperature.

In performing the wash durability testing method, the prepared fabric samples were cut into swatches (approximately 10 inch by 10 inch for Examples 1-3 and Comparative Examples 1-5, and approximately 14 inch by 14 inch for Example 4). The samples were stored in individual plastic (polyethylene) sealed bags prior to testing. Each prepared fabric sample was taken out of its bag and allowed to "air-out" for approximately five minutes. The fabric samples were then rated by the amount of scent detected as judged by a human evaluator. In Examples 1-3 and Comparative Examples 1-5, each human evaluator rated the amount of scent detected according to the following scale: very strong scent, strong scent, scent present, low scent, very low scent, and no scent detected. In Example 4, each human evaluator rated the amount of scent detected according to the following numerical scale: 5—very strong scent, 4—strong scent, 3—scent present, 2—low scent, and 1—no scent detected.

The testing procedure was conducted as follows:

First, the fabric samples were rated "as is" without aggressive handling or rubbing. Next, the fabrics were handled and elongated (to rupture microcapsules) and rated again. The fabric was then washed as described above, with a cut of the fabric taken at the appropriate wash cycle. The sample cut was allowed to air dry prior to evaluation. Concurrently, the remaining fabric was washed in additional laundering cycles until the next sample was taken, and so on. The samples were then evaluated at up to 0 (no wash, as processed), 1, 5, 10, and 15 wash cycles.

The invention may be further illustrated in view of the following examples:

EXAMPLES

In the examples that follow below, all mixtures were made at ambient temperatures (~25° C.).

Example 1

Preparation of Main Formulation Mixture

To about 1000 grams of water was added about 900 grams of CIBATEX RS-PC glyoxal type wrinkle resistant resin. To this mixture was added about 675 grams of SAPAMINE CKG alkoxylated fatty acid amide, alkyl sulfonate salt. The mixture was stirred well, either by hand or with an overhead stirrer. About eleven grams of glacial (99%+) acetic acid was then added to the mixture with stirring. This mixture was then added to about 10,314 grams of water. The container which had contained the mixture was then rinsed with about 100 grams of water and this rinse water was added to the main mixture.

Preparation of Microcapsule Slurry

To about 900.25 grams of water was slowly added about 99.75 grams of Peppermint Microcapsules (ideally this addition was done with constant stirring via an overhead mixer or laboratory blender to achieve the most homogeneous dispersion). This diluted peppermint microcapsule dispersion was added to the main formulation mixture. To the container used for the dilution of the Peppermint microcapsules was added about 1000 grams of water to rinse the remaining contents. The about 1000 grams of water was then added to the main formulation mixture to result in a total mass of about 15,000 grams (about 15 kg or approximately 15 liters (L)).

Application to Fabric

The approximately 15 L of the formulation was transferred to a pad bath reservoir. A fabric sample comprising a 100% polyester knit, having a fabric weight of about 190 grams per square meter was then passed through the pad bath through a series of rollers followed by passing through rubber coated rolls set at a pressure setting of 1.5 tons resulting in a wet pick-up of about 110% (i.e., about 210 grams of formulation was picked-up by one square meter of the fabric). The fabric was then dried and the resin formulation cured by passing through a stenter frame oven set at 177° C. for 120 seconds.

Formulation for Example 1

The formulation parameters for Example 1 can be summarized as follows:

60 g/L CIBATEX RS-PC 45 g/L SAPAMINE CKG 0.75 g/L glacial acetic acid 6.65 g/L Peppermint Microcapsule 177° C. cure for 120 seconds Testing The intensity and durability of the microencapsulated scent treatment was evaluated by the testing procedure described above. The results were as shown in Table 1, representing the consensus of two human evaluators.

TABLE 1

| Number of Machine Wash Cycles (hang dry) | Scent without Rubbing or Elongation | Scent with Rubbing or Elongation |
|---|---|---|
| 0 (As Treated) | Very Strong | Very Strong |
| 1 | Strong | Very Strong |
| 5 | Present | Strong |
| 10 | Low | Present |
| 15 | Not detectable | Very Low/Low |

Example 2

Preparation of Main Formulation Mixture

The procedure for Example 1 was followed except CIBATEX RCT, an imidazole type wrinkle resistant resin, was used instead of CIBATEX RS-PC glyoxal type wrinkle resistant resin. In addition, the fabric was dried and the resin formulation cured by passing through a stenter frame oven set at 165° C. for 120 seconds rather than 177° C. for 120 seconds.

Formulation for Example 2

The formulation parameters for Example 2 can be summarized as follows:

60 g/L CIBATEX RCT
45 g/L SAPAMINE CKG
0.75 g/L glacial acetic acid
6.65 g/L Peppermint Microcapsule
165° C. cure for 120 seconds Testing The intensity and durability of the microencapsulated scent treatment was evaluated by the testing procedure described above. The results were as shown in Table 2, representing the consensus of two human evaluators.

TABLE 2

| Number of Machine Wash Cycles (hang dry) | Scent without Rubbing or Elongation | Scent with Rubbing or Elongation |
|---|---|---|
| 0 (As Treated) | Very Strong | Very Strong |
| 1 | Strong | Very Strong |
| 5 | Present | Strong |
| 10 | Low | Present |

Example 3

Preparation of Main Formulation Mixture

The procedure for Example 1 was followed except CIBATEX RS-PC glyoxal type wrinkle resistant resin was used with both SAPAMINE CKG and CIBATEX HM-FE softener.

Formulation for Example 3

The formulation parameters for Example 3 can be summarized as follows:

60 g/L CIBATEX RS-PC
30 g/L CIBATEX HM-FE
20 g/L SAPAMINE CKG
0.75 g/L glacial acetic acid
6.65 g/L Peppermint Microcapsule
177° C. cure for 120 seconds Testing The intensity and durability of the microencapsulated scent treatment was evaluated by the testing procedure described above. The results were as shown in Table 3, representing the consensus of two human evaluators.

TABLE 3

| Number of Machine Wash Cycles (hang dry) | Scent without Rubbing or Elongation | Scent with Rubbing or Elongation |
|---|---|---|
| 0 (As Treated) | Very Strong | Very Strong |
| 1 | Strong | Very Strong |
| 5 | Present | Strong |

Comparative Example 1

Preparation of Main Formulation Mixture

The procedure for Example 1 was followed except CIBATEX RS-PC glyoxal type wrinkle resistant resin was used without SAPAMINE CKG.

Formulation for Comparative Example 1

The formulation parameters for Comparative Example 1 can be summarized as follows:

60 g/L CIBATEX RS-PC
0.75 g/L glacial acetic acid
6.65 g/L Peppermint Microcapsule
177° C. cure for 120 seconds Testing The intensity and durability of the microencapsulated scent treatment was evaluated by the testing procedure described above. The results were as shown in Table 4, representing the consensus of two human evaluators.

TABLE 4

| Number of Machine Wash Cycles (hang dry) | Scent without Rubbing or Elongation | Scent with Rubbing or Elongation |
|---|---|---|
| 0 (As Treated) | Very Strong | Very Strong |
| 1 | Present | Strong |
| 5 | Very low | Present |

Comparative Example 2

Preparation of Main Formulation Mixture

The procedure for Example 1 was followed except CIBATEX RS-PC glyoxal type wrinkle resistant resin was used with CIBATEX HM-FE softener and without SAPAMINE CKG.

Formulation for Comparative Example 2

The formulation parameters for Comparative Example 2 can be summarized as follows:

60 g/L CIBATEX RS-PC
30 g/L CIBATEX HM-FE
0.75 g/L glacial acetic acid
6.65 g/L Peppermint Microcapsule
177° C. cure for 120 seconds Testing The intensity and durability of the microencapsulated scent treatment was evaluated by the testing procedure described above. The results were as shown in Table 5, representing the consensus of two human evaluators.

TABLE 5

| Number of Machine Wash Cycles (hang dry) | Scent without Rubbing or Elongation | Scent with Rubbing or Elongation |
|---|---|---|
| 0 (As Treated) | Very Strong | Very Strong |
| 1 | Present | Strong |
| 5 | Very low | Present |

Comparative Example 3

Preparation of Main Formulation Mixture

The procedure for Example 1 was followed except CIBATEX RS-PC glyoxal type wrinkle resistant resin was used with CIBATEX HM-DFS, a cross-linkable silicone softener, and without SAPAMINE CKG.

Formulation for Comparative Example 3

The formulation parameters for Comparative Example 3 can be summarized as follows:

60 g/L CIBATEX RS-PC
20 g/L CIBATEX HM-DFS
0.75 g/L glacial acetic acid
6.65 g/L Peppermint Microcapsule
177° C. cure for 120 seconds Testing The intensity and durability of the microencapsulated scent treatment was evaluated by the testing procedure described above. The results were as shown in Table 6, representing the consensus of two human evaluators.

TABLE 6

| Number of Machine Wash Cycles (hang dry) | Scent without Rubbing or Elongation | Scent with Rubbing or Elongation |
|---|---|---|
| 0 (As Treated) | Very Strong | Very Strong |
| 1 | Present | Strong |
| 5 | Very low | Present |

Comparative Example 4

Preparation of Main Formulation Mixture

The procedure for Example 1 was followed except SAPAMINE CKG was used without CIBATEX RS-PC. In addition, the fabric was dried by passing through a stenter frame oven set at 120° C. for 120 seconds rather than 177° C. for 120 seconds.

Formulation for Comparative Example 4

The formulation parameters for Comparative Example 4 can be summarized as follows:

40 g/L SAPAMINE CKG 0.5 g/L glacial acetic acid 6.65 g/L Peppermint Microcapsule 120° C. cure for 120 seconds Testing The intensity and durability of the microencapsulated scent treatment was evaluated by the testing procedure described above. The results were as shown in Table 7, representing the consensus of two human evaluators.

TABLE 7

| Number of Machine Wash Cycles (hang dry) | Scent without Rubbing or Elongation | Scent with Rubbing or Elongation |
|---|---|---|
| 0 (As Treated) | Very Strong | Very Strong |
| 1 | Very Low | Low |
| 5 | Not detectable | Very Low |

Comparative Example 5

Preparation of Main Formulation Mixture

The procedure for Example 1 was followed except SAPAMINE CKG was used with CIBATEX HM-FE softener and without CIBATEX RS-PC. In addition, the fabric was dried by passing through a stenter frame oven set at 120° C. for 120 seconds rather than 177° C. for 120 seconds.

Formulation for Comparative Example 5

The formulation parameters for Comparative Example 5 can be summarized as follows:

40 g/L SAPAMINE CKG 20 g/L CIBATEX HM-FE 0.5 g/L glacial acetic acid 6.65 g/L Peppermint Microcapsule 120° C. cure for 120 seconds Testing The intensity and durability of the microencapsulated scent treatment was evaluated by the testing procedure described above. The results were as shown in Table 8, representing the consensus of two human evaluators.

TABLE 8

| Number of Machine Wash Cycles (hang dry) | Scent without Rubbing or Elongation | Scent with Rubbing or Elongation |
|---|---|---|
| 0 (As Treated) | Very Strong | Very Strong |
| 1 | Very Low | Low |
| 5 | Not detectable | Very Low |

As can be seen by contrasting Examples 1-3 with Comparative Examples 1-5, fabric samples that contained the combination of SAPAMINE CKG plus a second component selected from CIBATEX RS-PC and CIBATEX RCT resulted in improved wash durability as compared to samples that (1) contained SAPAMINE CKG without either second component or (2) contained a second component without SAPAMINE CKG. The presence of certain softener materials, such as CIBATEX HM-FE or CIBATEX HM-DFS, did not significantly impact wash durability.

Example 4

In Example 4, a formulation according to the invention and five different comparative formulations were tested on four different fabric types.

Example 4

Inventive Formulation 4

10 grams of Peppermint Microcapsules was added to about 500 grams of water adjusted to a pH 5.5 with constant stirring in a laboratory blender to achieve a homogeneous dispersion. While continuously mixing, 10 grams of a 25% solution of binder of Binder ST was added to the mixture. The mixture was stirred for 3 minutes at high shear, then the mixed speed was adjusted to a slow stirring rpm and 10 grams of Kelmar AF 2340 amino-silicone softener was added to the solution while stirring. The stirring was continued for 2 minutes, and then the solution was transferred to a second container where is it was further diluted to a final volume of 1.0 liter with water having a pH of 5.5. This solution was used as-is for treating small fabric samples.

Comparative Formulation 4A 10 grams of Peppermint Microcapsules was added to about 500 grams of water adjusted to a pH 5.5 with constant stirring in a laboratory blender to achieve a homogeneous dispersion. While continuously mixing, 10 grams of a 5% solution of Devabound C, supplied by Devan, was added to the solution, followed by 10 grams of a 25% solution of binder of Binder ST. The mixture was stirred for 3 minutes, then further diluted to a final volume of 1.0 liter with water having a pH of 5.5. This mixture was used as-is for the treatment of fabric samples on a lab padding and oven framing equipment manufactured by Roaches International Ltd.

Comparative Formulation 4B 10 grams of Peppermint Microcapsules was added to about 500 grams of water adjusted to a pH 5.5 with constant stirring in a laboratory blender to achieve a homogeneous dispersion. While continuously mixing, 10 grams of a 25% solution of binder of Binder ST was added to the mixture. The mixture was stirred for 3 minutes, then further diluted to a final volume of 1.0 liter with water having a pH of 5.5. This mixture was used as-is for the treatment of fabric samples on the lab padding and oven framing system manufactured by Roaches International Ltd.

Comparative Formulation 4C 10 grams of Peppermint Microcapsules was added to about 500 grams of water adjusted to a pH 5.5 with constant stirring in a laboratory blender to achieve a homogeneous dispersion. While continuously mixing, 10 grams of silicone binder solution, Shin Itzu KM2002, supplied by the Shin-Etzu Silicones of America, was added to the mixture. The mixture was stirred for 3 minutes. The stirring was continued for 2 minutes, and then the solution was transferred to second container where it was further diluted to a final volume of 1.0 liter with water having a pH of 5.5. This solution was used as-is for treating small fabric samples.

Comparative Formulation 4D 10 grams of Peppermint Microcapsules was added to about 500 grams of water adjusted to a pH 5.5 with constant stirring in a laboratory blender to achieve a homogeneous dispersion. While continuously mixing, the following silicone binders and catalyst were added to the mixture in order: 10 grams of DC2-8818, 2.5 grams of DC 75SF, and 1 gram of DC 62, all supplied by Dow Corning Corporation. The stirring was continued for 2 minutes, and then the solution was transferred to second container where is it was further diluted to a final volume of 1.0 liter with water having a pH of 5.5. This solution was used as-is for treating small fabric samples.

Application to Fabric

Inventive Formulation 4 and Comparative Formulations 4A-4E were tested (except as indicated in Table 9) on four different fabric samples, A, B, C, and D. Fabric Sample A was a 100% polyester knit fabric, having a basis weight of 190 grams per square meter and a wet pick up of approximately 110%. Fabric Sample B was an elastified cotton knit fabric made with 50 count single yarns having a basis weight of 165 grams per square meter and a wet pick up of approximately 102%. Fabric Sample C was an elastified polyester tricot knit construction consisting of 150 denier 100 filament polyester yarns having a spandex content of 8% 40 denier LYCRA® spandex, a basis weight of 195 grams per square meter, and a wet pick-up of approximately 91%. Fabric Sample D was a nylon warp knit construction consisting of 40 denier 13 filament nylon yarn having a spandex content of 22% 54 denier LYCRA® spandex, a basis weight of 165 grams per square meter, and a wet pick up of approximately 70%. Each of these fabric samples was immersed into each of the above solutions to completely wet the fabric with the solution. Each sample was then fed through padder squeeze rolls, and then placed on a pin frame and entered into a frame forced air oven for drying and curing. For Inventive Formulation 4 and Comparative Formulations 4A and 4B, the oven air temperature was set to 110° C. and the dwell time was set to 3 minutes. For Comparative Formulations 4C-4E, the oven air temperature was set to 165° C. and the dwell time was set to 3 minutes.

The results of the evaluation are shown in Table 9:

TABLE 9

| | Fabric Type/ | | | | | | | | | | | | | | | |
|---|---|---|---|---|---|---|---|---|---|---|---|---|---|---|---|---|
| | A | | | | B | | | | C | | | | D | | | |
| | Number of Washes | | | | | | | | | | | | | | | |
| | 0 | 5 | 10 | 15 | 0 | 5 | 10 | 15 | 0 | 5 | 10 | 15 | 0 | 5 | 10 | 15 |
| Inventive Form. 4 | 5 | 4.5 | 4.25 | 4 | 5 | 4.5 | 4 | 3.5 | Not tested | | | | 5 | 2.5 | 2.5 | 2.5 |
| Comparative Form. 4A | 5 | 4 | 3.5 | 3 | 5 | 2.5 | 2.5 | 2 | Not tested | | | | 5 | 2.5 | 2.5 | 2 |
| Comparative Form. 4B | 5 | 3.5 | 3 | 2 | 5 | 4.25 | 3.75 | 3 | 5 | 4.5 | 4 | 4 | 5 | 2.5 | 2 | 2 |
| Comparative Form. 4C | 5 | 4 | 4 | 3 | 5 | 2.5 | 2.5 | 2.5 | 5 | 3.75 | 2.5 | 2.5 | 5 | 2.5 | 2.5 | 2 |
| Comparative Form. 4D | Not tested | | | | 5 | 3.5 | 3.5 | 3 | 5 | 3 | 2.8 | 2.5 | 5 | 3 | 3 | 3 |
| Comparative Form. 4E | 5 | 3.5 | 3 | 3 | 5 | 4 | 3.5 | 3 | 5 | 3.5 | 3 | 3 | 5 | 2.5 | 2 | 2 |

Comparative Formulation 4E 10 grams of Peppermint Microcapsules was added to about 500 grams of water adjusted to a pH 5.5 with constant stirring in a laboratory blender to achieve a homogeneous dispersion. While continuously mixing, the following silicone binders and catalyst were added to the mixture in order: 10 grams of DC 1101, 2.5 grams of DC 75SF, and 1 gram of DC 62, all supplied by Dow Corning Corporation. The stirring was continued for 2 minutes, and then the solution was transferred to second container where is it was further diluted to a final volume of 1.0 liter with water having a pH of 5.5. This solution was used as-is for treating small fabric samples.

While all the fabrics retain some scent through to 15 wash cycles, the fabrics treated with the Formulation consistently showed the best scent retention. Further, these fabrics showed the softest tactile hand.

The invention claimed is:

1. A binder system comprising microcapsules and a binder composition, wherein the binder composition comprises:

(i) an alkoxylated fatty acid amide, alkyl sulfonate salt; and (ii) a component selected from the group consisting of, a glyoxal type wrinkle resistant resin, an imidazole type wrinkle resistant resin, and mixtures thereof.

2. A method of making a binder system comprising microcapsules and a binder composition wherein the method comprises combining said microcapsules with a binder composition, wherein the binder composition comprises:

(i) an alkoxylated fatty acid amide, alkyl sulfonate salt, and (ii) a component selected from the group consisting of: a glyoxal type wrinkle resistant resin, an imidazole type wrinkle resistant resin, and mixtures thereof.

3. A fabric comprising microcapsules and a binder composition, wherein the binder composition comprises:

(i) an alkoxylated fatty acid amide, alkyl sulfonate salt; and (ii) a component selected from the group consisting of: a glyoxal type wrinkle resistant resin, an imidazole type wrinkle resistant resin, and mixtures thereof.

* * * * *